US007617818B1

(12) United States Patent
Túrchik et al.

(10) Patent No.: US 7,617,818 B1
(45) Date of Patent: Nov. 17, 2009

(54) APPARATUS AND METHODS EMPLOYING BURST FORCE PROPULSION

(75) Inventors: David Túrchik, Corona, CA (US); William Mark Forti, Claremont, CA (US)

(73) Assignee: William Mark Corporation, Claremont, CA (US)

( * ) Notice: Subject to any disclaimer, the term of this patent is extended or adjusted under 35 U.S.C. 154(b) by 279 days.

(21) Appl. No.: 10/215,493

(22) Filed: Aug. 8, 2002

Related U.S. Application Data

(63) Continuation-in-part of application No. 09/677,944, filed on Oct. 2, 2000, now abandoned.

(51) Int. Cl.
*F41B 11/00* (2006.01)

(52) U.S. Cl. ..... 124/64; 124/56; 124/71; 124/75; 102/502; 446/212; 446/56; 446/63

(58) Field of Classification Search ..... 124/71, 124/56, 63, 64, 60, 75; 102/502; 89/1.81; 446/211, 212, 56, 63
See application file for complete search history.

(56) References Cited

U.S. PATENT DOCUMENTS

| | | | | | |
|---|---|---|---|---|---|
| 3,014,308 | A | * | 12/1961 | Parris | 446/52 |
| 4,565,131 | A | * | 1/1986 | Buchner | 102/444 |
| 4,802,677 | A | * | 2/1989 | Homan | 473/578 |
| 5,230,324 | A | * | 7/1993 | Van Horssen et al. | 124/61 |
| 5,282,453 | A | * | 2/1994 | Chia | 124/20.1 |
| 5,365,913 | A | * | 11/1994 | Walton | 124/75 |
| 5,381,778 | A | * | 1/1995 | D'Andrade et al. | 124/69 |
| 5,429,030 | A | * | 7/1995 | Tidman | 89/7 |
| 5,653,215 | A | * | 8/1997 | Chung et al. | 124/66 |
| 5,653,216 | A | * | 8/1997 | Johnson | 124/69 |
| 5,743,246 | A | * | 4/1998 | Mattern | 124/56 |
| 5,765,923 | A | * | 6/1998 | Watson et al. | 299/13 |
| 5,785,038 | A | * | 7/1998 | Mattern | 124/56 |
| 5,961,074 | A | * | 10/1999 | Dunn | 244/135 R |
| 6,247,990 | B1 | * | 6/2001 | Moorhouse | 446/64 |
| 6,283,037 | B1 | * | 9/2001 | Sclafani | 102/502 |
| 6,361,393 | B1 | * | 3/2002 | Seymour | 446/34 |
| 6,460,531 | B1 | * | 10/2002 | Gourley et al. | 124/64 |
| 6,500,042 | B1 | * | 12/2002 | LaPointe | 446/64 |
| 6,568,170 | B1 | * | 5/2003 | Rives | 60/221 |

FOREIGN PATENT DOCUMENTS

WO WO 02/057613 A2 * 7/2002

OTHER PUBLICATIONS

"Plastic." Wikipedia, the Free Encyclopedia. Jul. 6, 2006, 15:04 UTC. Wikimedia Foundation, Inc. Jul. 10, 2006 <http://en.wikipedia.org/w/index.php?title=Plastic&oldid=62379619>.*

* cited by examiner

*Primary Examiner*—J. Woodrow Eldred
(74) *Attorney, Agent, or Firm*—Fish & Associates, PC

(57) ABSTRACT

An apparatus has a container with a cavity containing a medium, and the container is sealed with a membrane that ruptures at a rupture pressure. A pressurizer pressurizes the cavity to at least the rupture pressure, and a projectile is disposed externally to the cavity during the pressurization. The projectile is propelled by the medium following rupture of the membrane. Preferred containers include pressurized cylinders, gun barrels, and ammunition cartridges, and preferred media include air, pressurized air and explosives, and a particularly preferred apparatus is a toy rocket launcher.

18 Claims, 2 Drawing Sheets

APPARATUS AND METHODS EMPLOYING BURST FORCE PROPULSION

This application is a continuation-in-part of U.S. application Ser. No. 09/677,944, filed Oct. 2, 2000 now abandoned.

FIELD OF THE INVENTION

The field of the invention is propulsion.

BACKGROUND OF THE INVENTION

It is a well-recognized fact in the mechanical arts that a change in a movement of an object requires a force, which may be derived from various energy sources, including natural and manmade energy sources. While natural energy sources (e.g., geothermal heat, or a flowing body of water) typically allow generation of relatively strong forces, natural energy sources are frequently confined to stationary use. In contrast, many man-made energy sources (e.g., combustion) advantageously allow mobility, however, they often require relatively complex configuration to operate efficiently, or at all.

To circumvent at least some of the problems with energy availability or complex configurations, energy may be stored temporarily by deforming or compressing a pliable or compressible material. For example, mechanical energy may be stored in a spring to propel an article. However, especially where relatively high energies are required to accelerate the article, springs may not be practicable. Moreover, when the energy is stored over a longer period, deformation of the spring may occur, thereby reducing the amount of potentially available energy.

In order to avoid loss of energy by deformation of an energized material, an object may be propelled by employing compressed air. A typical configuration for an air propelled flying toy is shown in U.S. Pat. No. 4,076,006 to Breslow et al., in which a toy rocket is propelled by compressed air. Breslow's rocket has a launching tube in fluid communication with a flexible bulb. The body of the toy rocket includes a recess that is configured to slide onto the launching tube, and the rocket is launched by compressing air in the flexible bulb, thereby forcing the rocket from the launcher. Breslow's rocket is relatively simple, however, the energy delivered to the rocket is limited to the force applied to the flexible bulb.

To increase the available amount of energy, Allport teaches in U.S. Pat. No. 3,739,764, a toy rocket launcher assembly in which a flexible hose is manually pressurized to a desired degree. The hose is pneumatically connected to an air valve, which in turn is connected to a launching tube. Allport's launcher advantageously allows launching of the toy rocket with a relatively higher force, but requires additional moving parts that may be prone to leakage or jamming. Furthermore, even if a relatively high pressure is produced in the flexible hose, a relatively large amount of the compressed air (i.e. energy) will be wasted by blowing off the launching tube after the rocket has already left the launcher.

Although various devices to propel an object are known in the art, all or almost all of them suffer from one or more disadvantages. Therefore, there is a need to provide improved methods and apparatus for devices to propel an object.

SUMMARY OF THE INVENTION

The present invention is directed to an apparatus comprising a container with a cavity containing a medium, wherein the cavity is sealed with a membrane that ruptures at a rupture pressure. A pressurizer is coupled to the cavity effecting pressurization of the cavity to at least the rupture pressure, and a projectile is disposed externally to the cavity during the pressurization and is propelled by the medium following rupture of the membrane. It is particularly contemplated that the apparatus is a toy rocket launcher with a toy rocket as the projectile.

In one aspect of the inventive subject matter, the cavity has a volume of less than 2 cubic inches, and more preferably less than 20 cubic inches, however, containers with a volume of greater than 20 cubic inches are also contemplated. Particularly preferred containers are fabricated from a metal, synthetic polymer, or a metal alloy, and may have various shapes (e.g., a cylindrical shape). Especially contemplated containers include a gun barrel and an ammunition cartridge.

In another aspect of the inventive subject matter, the membrane has preferably a flat shape, a biconcave, or biconvex shape, and it is contemplated that membranes are fabricated from a synthetic polymer, metal, inorganic material, or any reasonable combination thereof. The rupture pressure of contemplated membranes may vary considerably, however, rupture pressures greater than 10 psi or greater than 100 psi are particularly contemplated.

In a further aspect of the inventive subject matter, the pressurizer may comprise an internal or external pressurizer. Particularly contemplated internal pressurizers comprise an explosive, and particularly contemplated external pressurizers comprise a pump and a prepressurized vessel. The medium may comprise ambient air or a fluid, and preferably comprises a compressed gas or an explosive.

Various objects, features, aspects and advantages of the present invention will become more apparent from the following detailed description of preferred embodiments of the invention, along with the accompanying drawings in which like numerals represent like components.

DETAILED DESCRIPTION

A burst force, propulsion apparatus generally comprises a container with a cavity containing a medium, wherein the cavity is sealed with a membrane that ruptures at a rupture pressure. A pressurizer is coupled to the cavity effecting pressurization of the cavity to at least the rupture pressure, and a projectile is disposed externally to the cavity during the pressurization and is propelled by the medium following rupture of the membrane. It is contemplated that the burst force, propulsion apparatus may be employed in a wide variety of devices, and FIGS. 1-4 depict exemplary devices incorporating the inventive concept presented herein.

Figure 1:
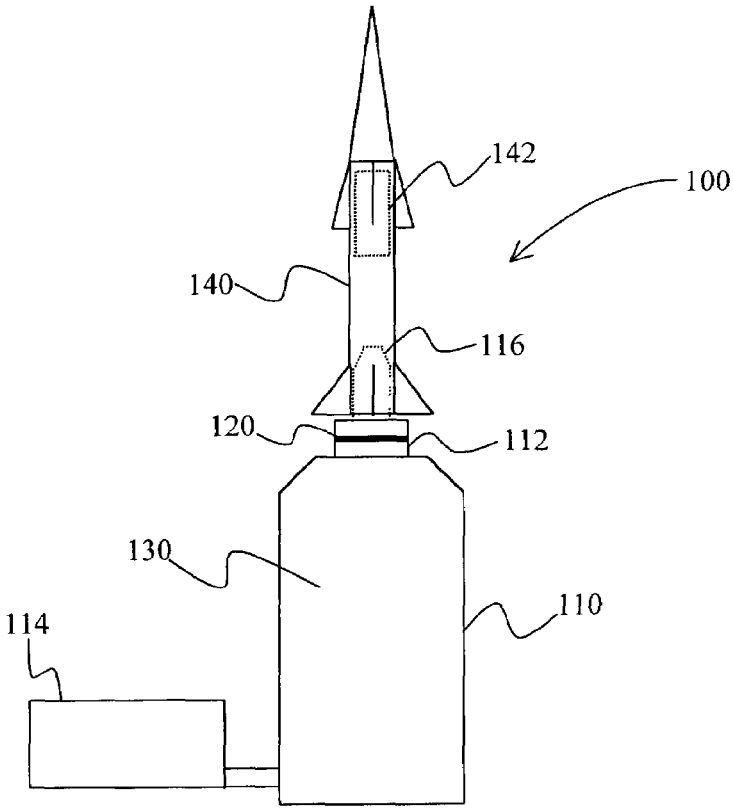
FIG. 1 is a schematic side view of an exemplary toy rocket launcher according to the inventive subject matter.

In FIG. 1, an exemplary toy rocket launcher 100 generally has a pressurizable container 110 with a cavity 130 and an opening 112. An external pressurizer 114 is coupled to the cavity, and a power ejection channel 116 is fluidly coupled to the opening 112. The membrane 120 is coupled to the opening 112 and retains the medium (not shown) within the cavity 130. External to the cavity is rocket 140 (with payload 142) that is slidingly engaged to the power ejection channel 116.

Toy rocket launcher 100 has preferably a cylindrical polyethylene (PE) tank as a container with a capacity of approximately 1500 ml air at ambient pressure, and a wall strength sufficient to withstand an internal pressure of up to 150 psi. The opening 112 is a hollow, cylindrical element attached to the top end of the tank, wherein the inside of the element is in fluid communication with the inside of the tank. The cylindrical element is approximately 1 inch in length and has an outer diameter of about ½ inch, an inner diameter of about ¼ inch, and is threaded on the outside. The membrane 120 is a round polyethylene (PE) foil of approximately 1/64 inch thickness and a diameter of about ⅜ inch. The PE foil is coupled to the opening by placing the foil on top of the opening, and securing the foil in place by holding the outer perimeter of the PE foil between the top of the opening of the cylindrical element and a second cylindrical element screwed onto the opening via a mating thread. The power ejection channel 116, preferably a PE cylinder with an inner diameter of about ¼ inch and a height of approximately 1.5 inch, is attached to the top side of the second cylindrical element and is in fluid communication with the inner diameter of the second cylindrical element. Cavity 130 preferably contains compressed air at a pressure of about 100 psi, which is introduced by the external pressurizer 114 (e.g., pressurized gas cylinder, or manual pump) that is fluidly coupled to the cavity 130. The toy rocket is preferably fabricated from PE, has a height of about 10 inches and an inner diameter sized and dimensioned to slidingly engage with the power ejection channel.

It is contemplated that in alternative aspects of the inventive subject matter the container of the toy rocket launcher need not be limited to a particular form, material, or capacity, so long as the container is capable of holding a medium under a pressure that is higher than a pressure that ruptures the rupturing member. Therefore, appropriate containers may include spherical, cylindrical, rectangular or irregularly shaped vessels. For example, where multiple containers are employed together in one or more launchers, rectangular containers may advantageously be stacked or otherwise arranged to minimize space requirements. On the other hand, where a launcher has an integrated container, appropriate containers may have an irregular shape to accommodate a particular environment within the launcher.

Likewise, the material of the contemplated launcher containers may vary considerably, and may include metals, metal alloys, natural and synthetic polymers, or any reasonable combination thereof. For example, where a low weight of a container is particularly desirable, the container may be fabricated from fiberglass composite materials. Alternatively, aluminum may be especially preferred where a relatively high resistance to internal pressure is desired, and where low cost manufacture is a particular objective, the container may be fabricated from plastic coated cardboard.

Depending on the material employed for the container, it should be appreciated that the wall or walls of alternative launcher containers need not be limited to rigid (i.e., non-elastic) materials, but may also include one or more elastic materials. For example, where it is desirable that the container is pressurized with a concomitant increase in container size or volume, one or more walls may be manufactured from rubber or a rubber-like material. Alternatively, an increase in size or volume may also be achieved by employing a wall or walls that fold in a predetermined pattern (e.g., bellow-type walls).

With respect to the volume of the container for the toy launcher, it is contemplated that many volumes are appropriate. Contemplated volumes are generally in a range of about 0.1 cubic inch, or less, to approximately several hundred cubic inches, and more. For example, where the launcher is employed to propel a relatively lightweight flying toy, suitable container volumes may typically be in the range of 0.05 cubic inch to about 50 cubic inches, and preferably between 10 cubic inches and 30 cubic inches. On the other hand, where the container encloses an amount of medium sufficient for multiple launches or for relatively high altitudes of the flying toy, appropriate volumes may be in the range of 50 cubic inches to several hundred cubic inches, and preferably between 75 cubic inches and 150 cubic inches.

Likewise, the pressure at which the container and the membrane enclose the medium need not be restricted to a particular pressure or pressure range, and contemplated pressures and pressure ranges may vary considerably among various launchers. For example, where a prepressurized container is employed, the pressure is typically not variable and will predominantly be limited by the material and wall strength of the container and the membrane. Alternatively, where contemplated containers are pressurized by an internal or external source, appropriate pressures may be in a relatively wide range, typically between atmospheric pressure and a pressure well below the burst pressure of the container.

For example, where a prepressurized container is employed in a launching device, a relatively low pressure of between atmospheric pressure and about 40 psi may be suitable to prevent serious injuries when the rupturing member is accidentally disintegrated. However, the pressure in the container need not be limited to 40 psi, and contemplated pressures may include a pressure of 1-39 psi, but also pressures between 40-1000 psi, and more. Similarly, where the container is pressurized by an internal or external pressure source, contemplated pressure ranges may lie between atmospheric pressure and 10 psi, preferably between atmospheric pressure and 50 psi, and more preferably between atmospheric pressure and 100 psi, or more.

It is further contemplated that appropriate launcher containers may be pressurized by various methods, including compression of at least a portion of the container, feeding a compressed medium into the container, thermal or other excitation of the medium within the container that increases molecular motion, and chemical generation of gas from a solid or a liquid. For example, where the container has a cylindrical shape and the bottom end of the cylinder is movably coupled to the cylinder in a gastight manner, the pressure may be increased by pushing the bottom portion into the cylinder. Alternatively, one or more feed lines may be attached to the cylinder and a pump or other pressure source may introduce the medium (e.g., compressed air) under pressure into the container. In still another example, a heat source (e.g., an electrical heater or microwave antenna) may evaporate water within the container, thereby increasing the pressure within the container. It is especially contemplated that where the pressure is generated from an internal pressure source, that the internal pressure source comprises an explosive or otherwise chemically reactive composition that undergoes a chemical reaction converting a solid, gelatinous, or liquid medium into a rapidly expanding gaseous phase. Thus, contemplated first pressures generated by an external or internal pressure source may be in the range of 0-10 psi, 10-100 psi, 100-1000 psi, 1000-10000 psi, and higher.

It is still further contemplated that the opening need not be restricted to a particular structure (e.g., the hollow cylindrical element of the toy rocket launcher) so long as the opening is fluidly coupled to the container. For example, contemplated alternative openings may include protrusions or indentations in the container, which may or may not include a mechanical coupling (e.g., a thread or bayonet lock). Other contemplated openings may comprise hollow flexible elements (e.g., a pressure resistant line) fluidly coupled to the container. In still other aspects of the inventive subject matter, it is contemplated that the container need not have a particular opening at all. For example, under the scope of this definition, an open end of an otherwise closed container (e.g., the open end of an otherwise closed cylinder) is regarded as an opening.

With respect to the membrane of the toy launcher it is contemplated that many materials and configurations other than a polyethylene foil are appropriate for use in conjunction with the teachings presented herein, so long as the membrane encloses a medium within the container at a pressure below the rupture pressure, and so long as the membrane ruptures at a pressure greater or equal to the rupture pressure. Particularly preferred membranes comprise natural and/or synthetic polymers (e.g., polyisoprenoids, cellulose, polyester, vulcanized rubber, etc.), inorganic materials (e.g., glass fibers), and any reasonable combination thereof.

Figures 5A, 5B, 5C:
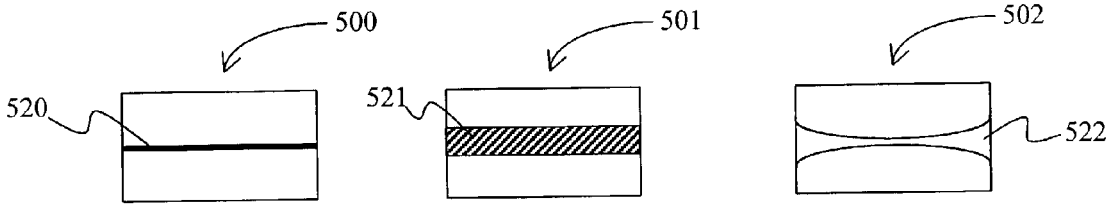
FIG. 5A is a schematic side view of an exemplary membrane according to the inventive subject matter.
FIG. 5B is a schematic side view of an exemplary membrane according to the inventive subject matter.
FIG. 5C is a schematic side view of an exemplary membrane according to the inventive subject matter.

For example, where the rupture pressure is relatively moderate (i.e., below 10 psi), natural and/or synthetic polymers such as polyester, polyethylene, vulcanized rubber, or polycarbonate are particularly preferred, and where desirable, may further comprise plasticizers or hardeners to modify the rupture characteristics of the membrane. Alternatively, where the rupture pressure is relatively high (i.e., above 100 psi), metals and/or fiberglass reinforced synthetic polymers, or compressed and/or sintered minerals may be utilized as a membrane. Contemplated membranes may have various configurations, including flat, convex, concave, symmetric and/or asymmetric configurations, and exemplary configurations of membranes are depicted in FIGS. 5A-5C, in which the membranes 520, 521, and 522 are coupled to openings 500, 501, and 502, respectively.

The membrane may be coupled to the opening in various positions including the outer portion of an opening, a peripheral or circumferential portion, or an inner portion. Similarly, the manner of coupling is not restricted to a particular mode, and may include a transient and permanent coupling. For example, where the membrane is fabricated from the same material as the container and the opening, it is contemplated that the membrane may be integrally formed by a molding process. Alternatively, the membrane may also be glued, welded, or bolted to the opening, and the mode of coupling will predominantly be determined by the material of the membrane. However, it is generally preferred that the membrane is temporarily coupled to the opening, and appropriate temporary closing modes include threadable coupling, latching, sliding, snapping, etc.

It should further be recognized, that the shape of the membrane in the toy launcher need not necessarily be limited to a foil, but may vary considerably. For example, contemplated alternative shapes include a flat, biconcave, or biconvex shape, and the shape will predominantly be determined by the threshold pressure, the size of the membrane, and economic considerations. For example, where the threshold pressure is relatively low, the membrane may have a shape of a foil or membrane. On the other hand, where the threshold pressure is relatively high, the membrane may have a disc or plug shape. While it is generally preferred that the membrane has a relatively simple shape (e.g., a foil), it is also contemplated that appropriate membranes may include a more complex configuration. For example, alternative membranes include reinforcing materials, such as an integral layer of fiberglass, or an external mesh or layer of metal threads. Where controlled rupture is particularly desirable, it is contemplated that the membrane may also include predetermined breakpoints (e.g., a perforation).

With respect to the rupture pressure at which the membrane of contemplated toy launchers rupture, it is contemplated that the actual rupture pressure will predominantly depend on the type, configuration, and material of the membrane. Thus, contemplated rupture pressures may vary considerably and may lie between 0.1 psi and several 100 psi or more. Contemplated rupture pressures may therefore be greater than 2 psi, greater than 20 psi, or greater than 40 psi. For example, where a toy rocket with a weight of less than 10 ounces is propelled, the rupture pressure may be in a range from about 1 psi or less to approximately 100 psi. Where heavier objects are propelled (e.g., a monowing toy) by the released medium, it is contemplated that the rupture pressure is greater than 100 psi, and the rupture pressure may preferably be in the range between 101 psi and several hundred psi. Where the medium comprises an explosive, it is contemplated that the rupture pressure may considerably exceed several hundred psi.

In a particularly preferred aspect of the inventive subject matter, it is contemplated that the membrane is coupled to the container with a coupling device, such that the membrane can be easily and quickly attached and detached from the container. For example, the coupling device may comprise a portion that snaps, latches, screws, bolts, or otherwise temporarily affixes a membrane to the container. In an especially preferred aspect of the inventive subject matter, the coupling device is configured such that a second membrane can be affixed to the container immediately after a first membrane is disintegrated. For example, the coupling device may include a frame along which a plurality of membranes may be moved in a rotating or sliding motion, such that a second membrane replaces a first membrane after the first membrane has disintegrated, wherein the movement of the membrane may be automated or manually operated.

With respect to the release of the medium from the container, it is contemplated that the medium may directly or indirectly exit the container. For example, a power ejection channel may receive the medium from the container before the medium contacts the toy that is to be propelled, and depending on the configuration of the ejection channel, the flow of medium may be focused or diffused. While it is generally contemplated that the medium is a gas or gas mixture (e.g., ambient air, or a reaction product of an explosive), it should be appreciated that various media other than a gas or gas mixture are also appropriate. Alternative media especially include a fluid, a fluid/gas mixture and a solid material, including an explosive.

While not wishing to be bound to any particular theory, it is contemplated that propulsion of a flying toy accelerated by the launcher according to the inventive subject matter may advantageously include the mass momentum of the released medium, and may additionally or solely also profit from the generation of a shock wave upon rupture of the rupturing member. Thus, the toy may be positioned in various ways, so long as the toy receives at least some of the released medium. For example, where a power ejection channel is employed, the toy may directly be positioned onto the power ejection channel. Alternatively, where the rupturing member is located within an opening of a container, the toy may be fully or partly disposed within the opening or container. In still other configurations, the toy may be positioned such that there is no immediate physical contact between the toy and the container, opening, or membrane.

In particularly preferred aspects, the flying toy is a toy rocket having a non-injurious payload. The term "non-injurious payload" as used herein refers to any load that during any phase of the operation of the toy (including launching, ascent, descent, and landing) will not pose a substantial risk to health and/or life of an operator and/or bystander, wherein the term "substantial risk to health and/or life" as used herein refers a condition that requires medical attention. For example, a bruise or scratch is not considered a substantial risk to health and/or life, while a trauma precipitated by an explosion (e.g., rupture of eardrum, partial or total amputation of a body part, etc.) falls within the scope of the above provided definition. Therefore, especially preferred non-injurious payloads include an optical and/or acoustical signal device (e.g., blinking lights, and/or electronic buzzer), a parachute, or air (e.g., where a toy projectile has no apparent payload). In contrast, particularly excluded from the definition of a non-injurious payload are explosives, biological, and/or chemical substances (e.g., as described in U.S. Pat. No. 5,365,913).

Still further, it is contemplated that where safety of operation of a toy rocket is particularly desirable, at least part of the toy rocket, if not even the entire toy rocket may be fabricated from a soft material. The term "soft material" as used herein refers to all materials that can be elastically deformed using manual force. Consequently, particularly preferred materials include foamed polymers, rubber, carton or other paper-based products, and all reasonable combinations thereof. Alternatively, it should be recognized that a toy rocket may include a tip with a shock absorbing portion. For example, the entire tip may be formed from a soft material top absorb the force of impact when the toy descends to the ground. In another example, the tip may include a spring (or otherwise elastic) element that absorbs at least part of the energy of impact.

In other contemplated aspects, the toy rocket may have (e.g., in addition to a soft tip) an element that reduces speed of descent, which additionally may produce a predetermined flight pattern. For example, where a slowed descent is desired, a parachute may be deployed upon descent. In another example, retractable wing may be deployed (e.g., spring operated and activated by reduced drag) on or near then apogee of flight to turn the rocket into a glider, or a deflector may be deployed to provide a tumble recovery (e.g., in spiraling or helicopter motion). Moreover, contemplated toy rockets may have any size or shape (e.g., fantasy or replica), and where contemplated toy rockets are operated by children, the rocket preferably has a weight of less than 100 g, more typically less than 50 g, and most typically less than 25 g. However, it should also be recognized that toy rockets may have significantly larger sizes, and may reach weights of between 100 g and 2000 g, and even more.

It should also be appreciated that the flying toy may include the container, opening, and membrane. For example, where a toy rocket includes a container with a pressurized medium and a membrane, the released medium may be employed to propel the flying toy out of a tube or other enclosing device. It is further contemplated that the distance between the membrane and the toy may vary considerably. While a relatively small distance between the membrane and the toy is generally preferred, larger distances are also contemplated. Thus, it is contemplated that the distance between the membrane and the toy is preferably more than 1 times the thickness of the membrane, more preferably more than 5 times the thickness of the membrane, and even more preferably more than 10 times the thickness of the membrane, or more.

In an alternative aspect of the inventive subject matter, many flying toys other than a toy rocket may be utilized in conjunction with the teachings presented herein, and appropriate flying toys include toys with one or more than one wing, toys with a parachute, or ballistic toys such as arrows, footballs, etc.

Figure 2:
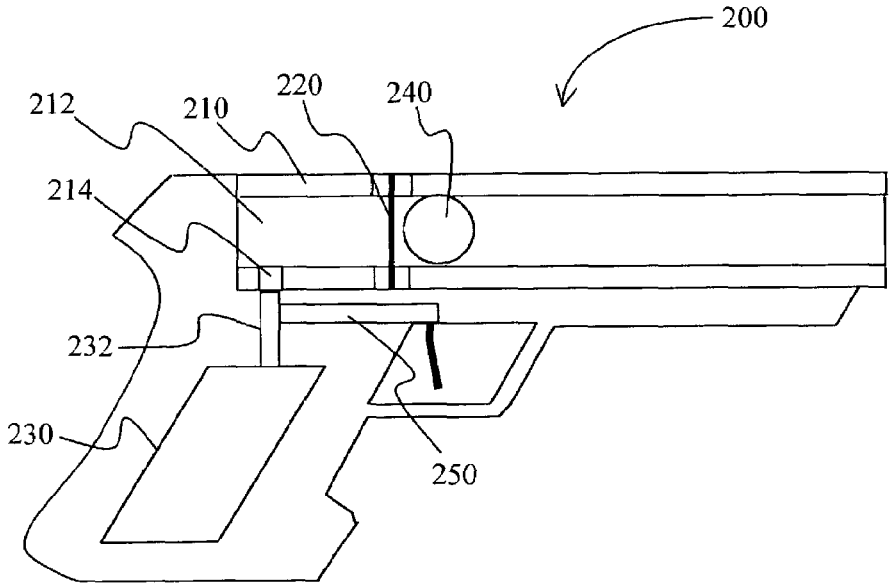
FIG. 2 is a schematic side view of an exemplary paintball gun according to the inventive subject matter.

In FIG. 2, an exemplary paintball gun 200 has a container (i.e., the barrel) 210, and cavity 212 is fluidly coupled to the compressed gas container 230 via feed line 232 and opening 214. The trigger mechanism 250 triggers a controlled flow of a predetermined amount of compressed air into the barrel 210. Membrane 220 is slidingly coupled to the container, and disposed in the barrel external to the cavity 212 is paintball 240.

The paintball gun 200 preferably has a barrel with a length of about 7 inches and an inner diameter of approximately 0.68-0.69 inch to accommodate commercially available standard paint balls. The opening 214, compressed gas container 230, feed line 232, and trigger mechanism 250 are preferably standard elements of commercially available paintball guns and are well known in the art. Membrane 220 comprises a PE membrane of approximately 0.6 inch diameter with a thickness of about 1/64 inch which is molded into a ring shaped membrane holder (outer diameter about 0.9 inch, inner diameter about 0.55 inch). The membrane is inserted into the barrel in an opening that corresponds in size and shape to the size and shape of the membrane, wherein the fit of the membrane with the barrel is gas tight, thereby closing cavity 212.

Figure 3:
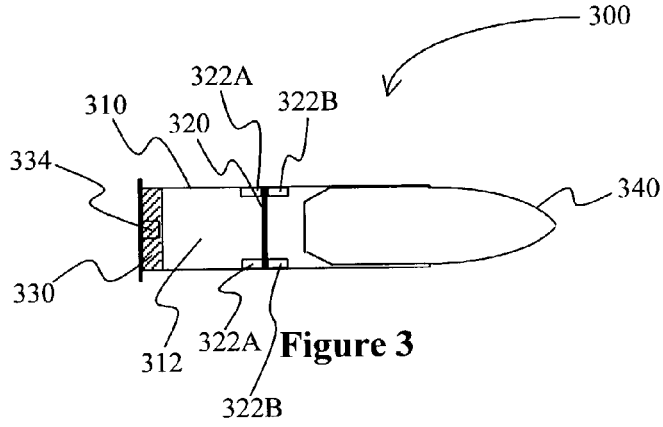
FIG. 3 is a schematic vertical cross sectional view of an exemplary cartridge according to the inventive subject matter.

In FIG. 3, an exemplary ammunition cartridge 300 has a shell 310 with cavity 312 and a projectile 340. Disposed on the bottom of the shell 310 is gunpowder 330 and fulminate 334, and between the gunpowder 330 and projectile 340 is membrane 320 held by upper and lower support rings 322A and 322B, respectively.

In a preferred cartridge 300, the shell 310 is a conventional center-fire caliber 38 shell, including conventional gunpowder 330 and fulminate 334, both of which are disposed on the inside of the bottom portion of the shell. Membrane 320 is a 1/16" Teflon™ (polytetrafluoroethylene) disc that is firmly held between the upper and lower support rings 322A and 322B both of which are spot welded into the shell 310. Projectile 340 is a standard caliber 38 lead projectile.

Figure 4:
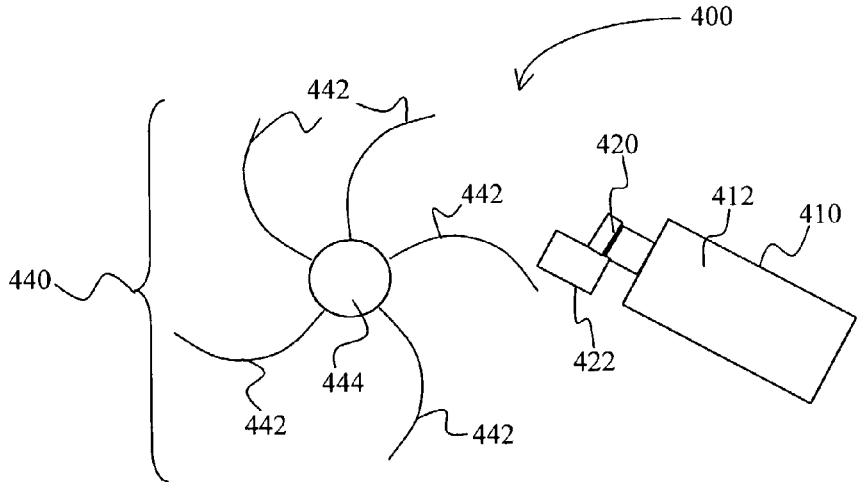
FIG. 4 is a schematic top view of an exemplary turbine assembly according to the inventive subject matter.

In FIG. 4, an exemplary turbine assembly 400 has a turbine wheel 440 with rotor element 444 and a plurality of turbine blades 442 attached to the rotor element. A container 410 with a cavity 412 is positioned proximal to the turbine blades such that medium (not shown) released from the container is received at least in part by at least one of the turbine blades. The container 410 is closed by the membrane 420, and a power ejection channel (not shown) is in fluid communication with the opening when the membrane is disintegrated. As can be seen in the exemplary configuration depicted in FIG. 4, it should be particularly appreciated that the burst force propulsion apparatus may produce a linear force, which can be easily converted into rotational momentum and power.

In one aspect of the inventive subject matter, the turbine wheel 440 of turbine assembly 400 has an overall diameter of approximately 4 inches. The rotor element 444 is preferably a PE cylinder with an outer diameter of about ½ inch and a length of approximately 1 inch, and is rotatably coupled (e.g., via needle bearing) to a stator (e.g., a Teflon™-coated metal rod; not shown). Attached (e.g., glued) to the rotor element are five rotor blades 442, which are preferably fabricated from PE. Each of the rotor blades has a length of about 1½ inch, a width of about 1 inch and a thickness of approximately ⅛ inch. The container 410 is preferably a cylindrical aluminum tank with a capacity of approximately 2500 ml air at ambient pressure, a wall strength sufficient to withstand an internal pressure of up to 150 psi, and an opening with a cylindrical element in fluid communication with the cavity 412. The membrane 420 is a PE membrane with a thickness of approximately 1/64 inch that covers the entire inner diameter of the cylindrical element and that is reversibly held to the cylindrical element by a frame in a sliding member. Membrane supply unit 422 supplies the membrane with a PE membrane once a PE membrane in the membrane is burst.

It is generally contemplated that in alternative aspects of the inventive subject matter the container need not be limited to a particular form, material, or capacity, so long as the container has a cavity capable of holding a medium under a pressure that is higher than the rupture pressure. Therefore, appropriate containers may include spherical, cylindrical, rectangular or irregularly shaped vessels. For example, where multiple containers are employed together in one or more burst force propulsion apparatuses, rectangular containers may advantageously be stacked or otherwise arranged to minimize space requirements. On the other hand, where a burst force apparatus has an integrated container, appropriate containers may have an irregular shape to accommodate to a particular environment within the apparatus. Likewise, the material of contemplated containers may vary considerably, and includes metals, metal alloys, natural and synthetic polymers, and any reasonable combination thereof. For example, where a low weight of a container is particularly desirable, the container may be fabricated from fiberglass composite materials. Alternatively, aluminum may be especially preferred where a relatively high resistance to internal pressure is desired.

Depending on the material employed for the container, it should be appreciated that the wall or walls of alternative containers need not be limited to rigid (i.e., non-elastic) materials, but may also include elastic materials. For example, where it is desirable that the container is pressurized with a concomitant increase in container size or volume, one or more walls may be elastic. Alternatively, an increase in size or volume may also be achieved by folding a wall in a predetermined pattern (e.g., bellow-type walls).

With respect to the volume of the cavity, it is contemplated that many volumes are appropriate, and contemplated volumes are generally in a range of about 0.1 cubic inch, or less, to approximately 100 cubic feet, and more. For example, where the container is a shell of an ammunition cartridge, suitable cavity volumes may be in the range of 0.05 cubic inch to about 5 cubic inches, predominantly depending on the caliber of the cartridge. On the other hand, where the cavity encloses an amount of medium sufficient for multiple releases of a medium, appropriate volumes may be in the range of several cubic inches to several hundred cubic feet, and more.

Likewise, the pressure at which the cavity and the membrane enclose the medium need not be restricted to a particular pressure or pressure range, and contemplated pressures and pressure ranges may vary considerably among various applications. For example, where the container includes a prepressurized cavity, the pressure is typically not variable and will predominantly be limited by the material and wall strength of the container and the desired application. Alternatively, where contemplated cavities are pressurized by an internal or external source, appropriate pressures may be in a relatively wide range, typically between atmospheric pressure and a pressure well below the burst pressure of the container.

For example, where a prepressurized cavity is employed in a launching device for toys, a relatively low pressure of between atmospheric pressure and about 40 psi may be suitable. Alternatively, where a prepressurized cavity is employed in a turbine, the cavity may include the medium at a pressure of 40-1000 psi, preferably 1000-5000 psi, and more preferably between 5000-10,000 psi, or more. Similarly, where the cavity is pressurized by an internal or external pressure source, contemplated pressure ranges may lie between atmospheric pressure and 40 psi, preferably between atmospheric pressure and 1000 psi, and more preferably between atmospheric pressure and 10,000 psi, or more.

It is further contemplated that cavities may be pressurized by various methods, including compression of at least a portion of the container, feeding a compressed medium into the cavity, thermal or other excitation of the medium within the cavity that increases molecular motion, and chemical generation of gas from a solid or a liquid. For example, where the cavity has a cylindrical shape and the bottom end of the cylinder is movably coupled to the cylinder in a gastight manner, the pressure may be increased by pushing the bottom portion into the cylinder. Alternatively, an external pressurizer may be fluidly coupled to the cavity to pressurize the cavity. For example, one or more feed lines may be attached to the cylinder and a pump, a vessel containing a pressurized medium, or other external pressure source may introduce the medium under pressure into the cavity. In still another example, a heat source (e.g., an electrical heater or microwave antenna) may heat evaporate water within the cavity, thereby increasing the pressure within the cavity. It is especially contemplated that where the pressure is generated from an internal pressure source (i.e., internal pressurizer), that the internal pressure source comprises an explosive or otherwise chemically reactive composition that undergoes a chemical reaction converting a solid, gelatinous or liquid medium into a rapidly expanding gaseous phase. Thus, contemplated pressures may be in the range of 0-10 psi, 10-100 psi, 100-1000 psi, 1000-10,000 psi, and higher.

It is further contemplated that the opening need not be restricted to a particular structure (e.g., the hollow cylindrical element of the toy rocket launcher) so long as the opening is fluidly coupled to the container. For example, contemplated alternative openings may include protrusions or indentations in the container, which may or may not include a mechanical coupling (e.g., a thread or bayonet lock). Other contemplated openings may comprise hollow flexible elements (e.g., a pressure resistant line) fluidly coupled to the container. In still other aspects of the inventive subject matter, it is contemplated that the container need not have a particular opening at all. For example, under the scope of this definition, an open end of an otherwise closed container (e.g., the open end of an otherwise closed cylinder) is regarded as an opening.

With respect to the membrane, it is contemplated that many materials and configurations other than a PE membrane are appropriate for use in conjunction with the teachings presented herein, so long as the membrane encloses a medium within the cavity at a pressure below the rupture pressure, and so long as the membrane ruptures at a pressure that is greater or equal than the rupture pressure. The size of the membrane is predominantly determined by the size of the opening, and it should be appreciated that there is no minimum or maximum size of the membrane, so long as the membrane is able to rupture. Particularly preferred membranes comprise natural and/or synthetic polymers (e.g., polyisoprenoids, cellulose, polyester, vulcanized rubber, etc.), inorganic materials (e.g., fiberglass), or any reasonable combination thereof. For example, where the rupture pressure is relatively moderate (i.e., below 100 psi), natural and/or synthetic polymers such as polyester, polyethylene, vulcanized rubber, or polycarbonate are particularly contemplated, and where desirable, may further comprise plasticizers or hardeners to modify the rupture characteristics of the membrane. Alternatively, where the rupture pressure is relatively high (i.e., above 1000 psi), metals and/or fiberglass reinforced synthetic polymers, or compressed and/or sintered minerals may be utilized as membranes.

Appropriate membranes may be coupled to the cavity or opening in various positions, including an outer portion of the cavity, a peripheral or circumferential portion, or an inner portion. Similarly, the manner of coupling is not restricted to a particular mode, and may include a permanent coupling, so long as the membrane seals the cavity. The term "seals the cavity" as used herein refers to closing the cavity such that substantially all of a medium enclosed within the cavity is retained within the cavity by the membrane. For example, where the membrane is fabricated from the same material as the container and the opening, it is contemplated that the membrane is integrally formed by a molding process. Alternatively, membranes may also be glued, welded, or bolted to the opening, and the mode of coupling will predominantly be determined by the material of the membrane. However, it should be appreciated that the membrane may also be temporarily coupled to the opening, and appropriate temporary closing modes include threadably coupling, latching, sliding, snapping, etc.

It should further be recognized, that the configuration of the membrane need not be necessarily limited to a membrane, but may vary considerably. For example, contemplated alternative configurations include a foil shape, a disc shape, a biconcave or biconvex shape, etc., and the configuration will predominantly be determined by the disintegration pressure, the size of the membrane, and economic considerations. For example, where the disintegration pressure is relatively low, the membrane may have a configuration of a foil. On the other hand, where the disintegration pressure is relatively high, the membrane may have a disc or plug configuration. While it is generally preferred that the membrane has a relatively simple configuration (e.g., a foil), it is also contemplated that appropriate membranes may include a more complex configuration. For example, it is contemplated that alternative membranes may include reinforcing materials, such as an integral layer of fiberglass, or an external mesh or layer of metal threads. Where controlled disintegration is particularly desirable, it is contemplated that the membrane may also include predetermined breakpoints (e.g., a perforation).

As used herein, the term "rupture" refers to a separation of the membrane into a plurality of component parts, which may or may not remain in contact with each other after the rupture event. However, the rupture may also include a chemical transformation component (e.g., forming of a hole in the closing membrane with an oxidant or laser beam to initiate rupture of the membrane). Thus, the term rupture of a membrane encompasses the formation of a simple cut or hole in the membrane, as well as rupture into multiple fragments (e.g., along predefined breakpoints), or pulverization. With respect to the rupture event, it is contemplated that the force that drives the rupture of the membrane is predominantly the rupture pressure, however, the rupture may also be initiated by mechanical (e.g., a spike, or blade) or other means (e.g., electrical or thermal).

With respect to the rupture pressure, it is contemplated that the actual rupture pressure will predominantly depend on the type, configuration, and material of the membrane. Thus, contemplated rupture pressures may vary considerably and may lie between 0.1 psi and several 10,000 psi or more. For example, where a toy rocket with a weight of less than 10 ounces is propelled, the rupture pressure may be in a range from about 1 psi or less to approximately 100 psi. Where heavier objects are propelled (e.g., a turbine wheel) by the released medium, it is contemplated that the rupture pressure is greater than 100 psi, and the rupture pressure may preferably be in the range between 50 and 5,000 psi. Where the medium comprises an explosive, it is contemplated that the rupture pressure may be between 5,000 and 10,000 psi or more. Typically, rupture pressures will be greater than 10 psi or greater than 100 psi. While it is generally contemplated that the pressure outside the container is typically atmospheric pressure, it should also be appreciated that the pressure outside the container may be a pressure other than atmospheric pressure, including pressures below atmospheric pressure (e.g., vacuum in outer space, or a vacuum produced by a vacuum pump), and pressures above atmospheric pressure.

In a particularly preferred aspect of the inventive subject matter, it is contemplated that the membrane is coupled to the cavity with a coupling device, such that the membrane can be easily and quickly attached and detached from the cavity. For example, the coupling device may comprise a portion that snaps, latches, screws, bolts, or otherwise temporarily affixes a membrane to the cavity. In an especially preferred aspect of the inventive subject matter, the coupling device is configured such that a second membrane can be affixed to the cavity immediately after a first membrane is ruptured. For example, the coupling device may include a frame along which a plurality of membranes may be moved in a rotating or sliding motion, such that a second membrane replaces a first membrane after the first membrane has ruptured, wherein the movement of the membranes may be automatic or manual. It is still further contemplated that multiple membranes may also be employed within a single opening, power ejection channel or other portion of the cavity.

With respect to the release of the medium from the container, it is contemplated that the medium may directly or indirectly exit the container. For example, a power ejection channel may receive the medium from the container before the medium contacts the object that is to be propelled, and depending on the configuration of the ejection channel, the flow of medium may be focused or diffused. While it is generally contemplated that the medium is a gas or gas mixture (e.g., ambient air, or a reaction product of an explosive), it should be appreciated that various media other than a gas or gas mixture are also appropriate. Alternative media especially include a fluid, a fluid/gas mixture and a solid material, including an explosive. While not wishing to be bound to a particular theory, it is contemplated that propulsion of an article accelerated by the burst force propulsion apparatus according to the inventive subject matter may advantageously include the mass momentum of the released medium, and may additionally or solely profit from the generation of a shock wave upon disintegration of the membrane. Thus, the article may be positioned in various ways, so long as the article receives at least some of the released medium. For example, where a power ejection channel is employed, the article may directly be positioned onto the power ejection channel. Alternatively, where the membrane is located within an opening of a container (e.g., see FIG. 3), the article may be fully or partly disposed within the opening or container. In still other configurations (e.g., see FIG. 4), the article may be positioned such that there is no immediate physical contact between the article and the container, opening, or membrane.

In a particularly contemplated aspect of the inventive subject matter, the projectile is propelled with sufficient force to produce a transitory vacuum within the cavity, wherein the term "vacuum within the cavity" as used herein refers to a pressure in the cavity that is lower than the atmospheric pressure. Therefore, the term vacuum includes all pressures between an absolute vacuum and a pressure that is 1 mbar, 10 mbar, 50 mbar, 100 mbar or more below atmospheric pressure.

It is still further contemplated that the projectile that is propelled need not be restricted to a toy rocket, a bullet, a paintball, or turbine wheel, and in alternative aspects the article may be any object that receives at least a portion of the released medium, and that has at least one degree of rotational or translational freedom. It is further contemplated that the projectile propelled by at least part of the released medium moves along a predetermined trajectory. As used herein, the term "predetermined trajectory" means that the direction and distance of a propelled projectile can be controlled, and that under substantially identical conditions a second projectile will be propelled along substantially the same path as a first projectile (wherein the path may be a linear path or a circular path). Furthermore, it should also be appreciated that the projectile may include the container, opening, and membrane. For example, where a toy rocket includes a cavity with a pressurized medium and a membrane, the released medium may be employed to propel the toy out of a tube or other enclosing device. It is further contemplated that the distance between the membrane and the projectile may vary considerably. While a relatively small distance between the membrane and the projectile is generally preferred, larger distances are also contemplated. Thus, it is contemplated that the distance between the membrane and the projectile is preferably more than 1 times the thickness of the membrane, more preferably more than 5 times the thickness of the membrane, and even more preferably more than 10 times the thickness of the membrane, or more.

It is still further contemplated that a burst force propulsion apparatus according to the inventive subject matter may generally be employed in a wide variety of applications other than toy rockets, paint ball guns, ammunition, and turbines, and appropriate uses include devices and methods in which a forceful movement of one object relative to a second object is desired. For example, it is contemplated that a burst force propulsion apparatus may be utilized in explosives to increase the initial velocity of an object driven by the explosion. Alternatively, the burst force propulsion apparatus may propel various toys, including flying, swimming, or rolling toys, and in still further alternative aspects, the burst force propulsion apparatus may be utilized in engines or turbines. Yet other uses of the burst force propulsion apparatus may include shockwave generators for medical use or deconstruction of natural or man-made structures.

Thus, specific embodiments and applications of burst force propulsion have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A toy comprising:

a container having a cavity containing air as a medium, wherein the cavity is sealed with a membrane that is configured to (a) enclose the medium within the cavity at a pressure of the medium below a rupture pressure, and to (b) rupture at a pressure of the medium that is greater or equal than the rupture pressure; and wherein the rupture pressure of the membrane is between 1 psi and 100 psi;

wherein the container further comprises an opening portion that has a threaded first section and a threaded second section, wherein first and second sections are screwed to each other via the threaded sections, and wherein the membrane is secured and disposed between the first and second elements;

a manually operable pressurizer coupled to the cavity that effects a controlled pressurization of the cavity to at least the rupture pressure;

a toy projectile having a non-injurious payload, wherein the toy projectile is disposed externally to the cavity during the pressurization and propelled by the medium following rupture of the membrane;

wherein the toy projectile is configured such that the projectile receives at least some of the released medium and is directly propelled by at least one of a mass momentum of the medium and a shock wave of the medium; and wherein the toy projectile is fabricated from a soft polymer or comprises a shock absorbing portion.

2. The toy of claim 1 wherein the toy projectile comprises a toy rocket, wherein the opening portion is configured such as to allow holding of an outer perimeter of the membrane between the first and second elements while the first and second elements are secured to each other via the threaded sections.

3. The toy of claim 2 wherein the opening portion is cylindrical and comprises an ejection channel that is in fluid communication with the second element.

4. The toy of claim 2 wherein the toy rocket further comprises an element that reduces speed of descent, and wherein the element is selected from the group consisting of a parachute, a retractable wing, and a deflector.

5. The toy of claim 1 wherein the payload is selected from the group consisting of an optical signal device, an acoustic signal device, and air.

6. The toy of claim 1 wherein the container is fabricated from a material selected from the group consisting of a synthetic polymer, a metal, and a metal alloy.

7. The toy of claim 1 wherein the container comprises a toy rocket launcher.

8. The toy of claim 1 wherein the cavity has a volume of more than 20 cubic inches.

9. The toy of claim 1 wherein the medium comprises a compressed gas.

10. The toy of claim 1 wherein the membrane comprises a synthetic polymer.

11. The toy of claim 1 wherein the membrane has a shape selected from the group consisting of a flat shape, a biconcave shape and a biconvex shape.

12. The toy of claim 1 wherein the rupture pressure is a pressure greater than 10 psi.

13. The toy of claim 1 wherein the rupture pressure is a pressure greater than 100 psi.

14. The toy of claim 1 wherein the pressurizer is disposed internal relative to the container.

15. The toy of claim 1 wherein the pressurizer is disposed external relative to the container.

16. The toy of claim 15 wherein the external pressurizer comprises a device selected from the group consisting of a pump and a vessel containing a pressurized medium.

17. The toy of claim 1 wherein the container contains the medium at a pressure sufficient to propel the toy projectile via at least one of a mass momentum of the medium after rupture of the membrane and a shock wave after rupture of the membrane.

18. The toy of claim 1 wherein the membrane is configured such that rupture of the membrane provides at least one of a mass momentum of the medium and a shock wave.

* * * * *